US005272682A

United States Patent [19]

Falcone

[11] Patent Number: 5,272,682

[45] Date of Patent: Dec. 21, 1993

[54] WATCH GUARD

[76] Inventor: Thomas J. Falcone, 9 Compass Ct., Oyster Bay, N.Y. 11771

[21] Appl. No.: 787,786

[22] Filed: Nov. 4, 1991

Related U.S. Application Data

[63] Continuation-in-part of Ser. No. 594,725, Oct. 9, 1990, abandoned, which is a continuation of Ser. No. 417,576, Oct. 5, 1989, abandoned.

[51] Int. Cl.[5] ..... A44C 5/00; G04B 37/00

[52] U.S. Cl. ..... 368/281; 368/283; 368/286

[58] Field of Search ..... 368/281-283, 368/286-291; 224/158, 164, 175

[56] References Cited

U.S. PATENT DOCUMENTS

| | | | |
|---|---|---|---|
| 1,249,906 | 12/1917 | Daw | 368/288 |
| 1,767,315 | 6/1930 | Schreiber . | |
| 1,857,195 | 5/1932 | Karpf | 361/286 |
| 2,076,221 | 4/1937 | Bradbury | 368/286 |
| 2,182,830 | 12/1939 | Vedder | 368/286 |
| 2,227,131 | 12/1940 | Friedman | 368/286 |
| 2,249,350 | 7/1941 | Williams | 368/286 |
| 2,344,136 | 3/1944 | Dressen | 368/291 |
| 2,553,089 | 5/1951 | Holder | 368/286 |
| 2,584,270 | 2/1952 | Hucknall | 58/105 |
| 2,601,942 | 7/1952 | Pachter | 224/4 |
| 2,635,416 | 4/1953 | Mietchen | 58/105 |
| 2,649,230 | 8/1953 | Thompson | 224/4 |
| 2,998,695 | 9/1961 | Cornett | 368/286 |
| 4,155,219 | 5/1979 | Anderson | 368/286 |
| 4,684,264 | 8/1987 | Paperno | 368/283 |
| 4,916,679 | 4/1990 | Agnello | 368/283 |

*Primary Examiner*—Vit W. Miska
*Attorney, Agent, or Firm*—Alfred M. Walker

[57] ABSTRACT

A wrist watch and band protector. The wrist watch and band protector has a substantially circular body portion, a pair of extensions formed on and emanating from the body portion such that each extension of the pair of extensions are disposed mutually opposite each other on the body portion and are colinear, and fastener for fastening each extension of the pair of extensions around the wrist watch so that the wrist watch crystal, the wrist watch in general, and the wrist watch band, are protected from breakage.

1 Claim, 3 Drawing Sheets

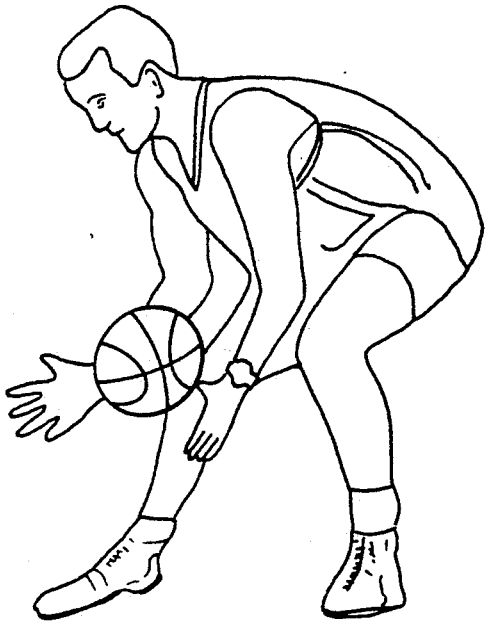
Fig. 2
Fig. 6
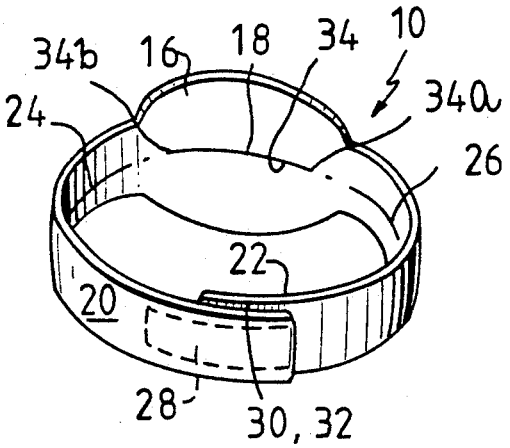
Fig. 7
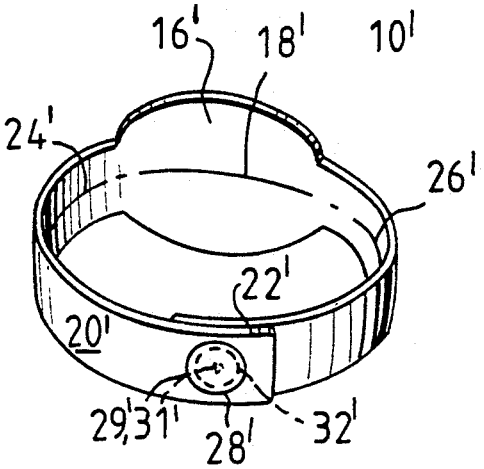
Fig. 8
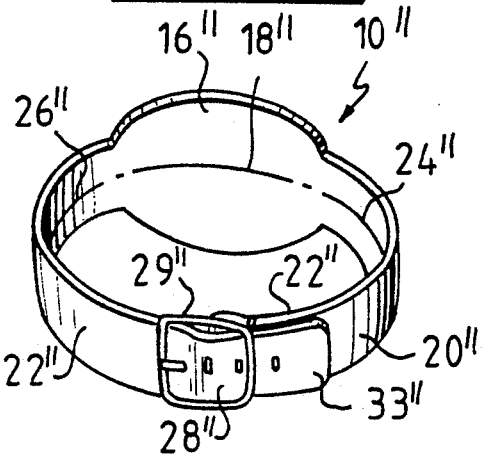

WATCH GUARD

This application is a continuation in part of application Ser. No. 07/594,725 filed Oct. 9, 1990, which is a continuation of application Ser. No. 07/417,576 filed Oct. 5, 1989, both abandoned.

BACKGROUND OF THE INVENTION

1. Field of the Invention

The present invention relates to a watch guard device.

More particularly, the present invention relates to a one piece watch guard that forms an integral unit with the watch.

2. Description of the Prior Art

The U.S. Pat. No. 1,657,559 to Taylor relates to a watch holder in which a watch is placed and suspended from a belt or suspender strap.

The U.S. Pat. No. 1,657,559 to Taylor teaches a watch holder that consists of a pocket having a rear wall 1 and a front wall 2. These walls are formed from leather blanks having their marginal portions turned inwardly, and sewed together. The front and rear walls, when sewed together, form a pocket that is open at its top and is of a size to receive the watch 4. The front and rear walls of the pocket are lined with a soft material so that if a gold or other valuable watch is placed in the pocket it will not be scratched. A portion of the front wall is cut out to provide a flap 7 adapted to be moved from the closed position to an opened position so that the face of the watch is exposed to view.

The U.S. Pat. No. 2,511,105 to Fenyvessy relates to watch holders.

Because of its convenience, the wrist watch has been widely adopted by men. There are many men who work at occupations, however, such as in a photographic dark room, where it is necessary to put the hands constantly into water or into a developer where wearing a wrist watch is not practical. There are other occupations where a wrist watch may easily be damaged while at work by striking a wall or other hard object. For men working in such industries, the ordinary watch and chain for the vest is not satisfactory either.

The U.S. Pat. No. 2,511,105 to Fenyvessy teaches a watch holder 10 that has three fabric straps 11, 12, and 13. These straps are fastened together at their ends. Rows of stitches 15 and 16 are used for this purpose. The row of stitches 15 is removed from the adjacent ends of the straps 11, 12 and 13 for a tab 19.

The U.S. Pat. No. 2,635,416 to Mietchen relates to protective enclosures for wrist watches.

Mechanics or other workmen subject a wrist watch to exposure in places where grease, dust or other contaminating substances are likely to be encountered.

The U.S. Pat. No. 2,635,416 to Mietchen teaches a protective enclosure 10 that consists of a base 11 and a recessed cover 12 which engages the base 11 so as to form a separable housing structure. The two ends of the base are notched for engagement by the usual strap 14, which is used to fasten the watch to the wrist of the wearer.

U.S. Pat. No. 2,998,695 to Cornett relates to a wrist watch and band protector.

The U.S. Pat. No. 2,998,695 to Cornett teaches a device which is adapted to be adjusted and fitted on the wrist before a watch and its band are applied. The watch and band are then circumposed on the device which is closed around the watch and the band.

The device 10 consists of a wrist watch band enclosing component 12, and a watch enclosing component 14. The component 12 is composed of two substantially similar sections 16 and 18, which are in the form of circumferentially elongated, generally rectangular sheets of flexible material, having inner or first ends 20 and 22, respectively, and outer or second free ends 24 and 26, respectively.

The watch enclosing component 14 consists of a single rectangular sheet of flexible material, substantially wider than the sections 16 and 18. The inner ends of the sections 16 and 18 are secured to and extend from opposite ends of the component 14, by imposing on the upper surface 28 of the component 14 and secured thereon, by suitable means.

The U.S. Pat. No. 3,552,117 to Parris relates to a jacket which is fashioned from a sheet of suitably bendable rubber and has a front cover flap which is separably fastened to a rear backing flap, the latter flap being interiorly provided with a relatively small stirrup-like loop for attaching and suspending the watch between the flaps.

Stainless steel and analogous waterproof watches if subjected to certain acids, even for a month or so, are vulnerable to the effects of tarnish, soon get out of order, will not run properly, and eventually stop running altogether. With the exception of woodworkers, carpenters and cabinet makers for example, virtually all construction workers use acid of one kind or another. For instance, painters use salsoda, ammonia, muratic acid, acetone and the like. Melting metals such as lead, zinc and steel throw off deleterious acid-laden fumes which when combined with perspiration can be and are damaging to component watch parts.

The U.S. Pat. No. 3,552,117 to Parris teaches an elongated normally flat cut-out rubber sheet 6. This sheet when spread flatwise is six inches more or less in length but be proportionately enlarged for large size watches. The sheet is one piece construction and of uniform thickness from end to -end. The sheet has a substantially rectangular central body portion with tapering end portions. The central body portion can be two and one-half inches wide at its widest part. A bendable fold line 8 divides the sheet into a first half-portion and a second half-portion.

The U.S. Pat. No. 4,155,219 to Anderson relates to a wrist watch protector that consists of a flexible wrist encircling band for covering the watch with a centrally located opening for viewing the face of the watch. A quick-opening flap secured to the top of the wrist band covers the watch crystal. Utilization of a watch-carrying band strap located between the band and the flap allows the protector to optionally serve as a watch band by threading the strap through the bracelet attaching pins carried by the watch body.

In recent years wrist watches have come to be recognized more as articles of jewelry than as time-pieces. People at all economic levels own wrist watches of original artistic designs which often contain precious metals or precious stones. Frequently, a wrist watch is the only piece of jewelry which a man will wear, and often is the subject of great pride to the owner.

Many people engage in activities where damage to a wrist watch may occur. Carpenters, plumbers, painters, iron workers, welders, and others working in a building trade constantly expose their wrist watches to abrasion and blows. Construction and factory workers may also be exposed to acid, alkali or other chemicals which can damage the metal finish or etch away the glass or plastic crystal.

Fumes or excess moisture can easily penetrate the watch casing and corrode or otherwise deleteriously effect the inner working of the watch. Even people who do not have physically active jobs frequently expose their watches to damage when working around the house. The risks of damage to expensive watches are well known, and many attempts have been made in the past to protect watches from these damages.

In general, wrist watch protectors have fallen into two types; a first variety of cuff-type wraparound protectors which simply fit over the watch on the wrist, and a second tube type protectors into which the watch is placed, with the whole assembly placed on the wrist.

Representative of the first variety are the wraparound devices of Williams, U.S. Pat. Nos. 2,249,550, Dressen, U.S. Pat. No. 2,344,136 and Karpf, U.S. Pat. No. 1,857,195. These devices are generally slip-on covers which seal the watch against intrusions of water and dirt. Hucknall, U.S. Pat. No. 2,584,270 shows a combination of a wrap around elastic bracelet with a hard plastic shield through which the face of the watch can be seen.

U.S. Pat. No. 2,553,089 also discloses a wraparound bracelet having a transparent face through which the watch can be seen. The bracelet itself is decorative as well as protective.

Protective devices which completely enclose the watch may cover the total of the watch or only a portion thereof. For example, Schreiber, U.S. Pat. No. 1,767,315 discloses a protective cover which buckles around the face of the watch leaving the strap intact. A device which encloses the face is and a portion of the band is shown in Vedder, U.S. Pat. No. 2,182,830. Tubular devices where the watch is completely enclosed in the protective cover prior to placing on the wrist of the wearer are shown in Bradbury, U.S. Pat. Nos. 2,076,221 and Friedman, U.S. Pat. No. 2,227,131. Another type of protector is shown in Cornett, U.S. Pat. No. 2,998,695 which discloses a wide band which is placed on the wrist of the wearer before the watch is put in place. After placing the watch on his wrist, the wearer then rolls side flaps which exist on the band over the top of the watch,.attaching the flaps together with snaps and forming a protective cover.

Still other protective coverings have required removal of the watch band components from the wrist watch and place the remaining watch body in a special carrier which can be carried in the user's pocket. For example, Fenyvessy, U.S. Pat. No. 2,511,105 discloses a stitched leather protective pouch which may be inserted or pinned to the pocket of the user. Parris, U.S. Pat. No. 3,552,117 shows a similar device in which the watch is suspended by a quick release strap.

The U.S. Pat. No. 4,155,219 to Anderson teaches a wrist watch consisting of a flat flexible wrist encircling band having a inner surface adapted to cover the wrist watch fastening means carried by the band for adjustably fixing the band around the wearer's wrist, an opening centrally located in the band to allow the wearer to view the face of the watch, a flexible cover flap having one end thereof secured to the outer surface of the band, and an inner engaging fastening means attached to the lower surface of the second end of the cover flap and the upper surface of the band.

Wrist watch protector 1 has a wrist encircling band made from lower member 2 and the rear portion 3 of upper member 4. The forward portion 5 of the upper member serves as a flap to cover the watch crystal which would extend through opening 6 in the lower member. The upper member is fastened to the lower member by studs 10, 11, and 12 which separate the forward from the rear portions of the member. These studs are conventional fastening members which are applied by press fitting to the two members. Lower member 2 has an upper surface 13 and a lower surface 14. The upper member has an upper surface 15 and a lower surface 16. If desired, the lower member could also consist of the rear portion of the upper member. The wrist encircling band would be one entire piece and upper flap 5 would be a separate piece commencing at the fastening members.

To enable rapid and convenient use by the wearer, the wrist band and flap are held in place by quickly releasable fastening members which may be snap fasteners or other male-female type connectors.

As can be seen, numerous innovations for watch guards have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a watch guard device which avoids the disadvantages of the prior art.

More particularly, it is an object of the present invention to provide a watch guard device that is an all-season, indoor, outdoor watch cover for the sports and outdoor person. Its purpose is to protect the face of the watch and band from scratches and abrasions, during sporting and other laborious activities.

When a person is engaged in sports or other laborious activities, removing their watch is not always practical or desired. In removing the watch there is fear of damage. A person can forget where he put it or end up losing the watch, often times it being an expensive one.

In keeping with these objects, and with others which will become apparent hereinafter, one feature of the present invention resides, briefly stated, in a wrist watch and band protector, and consisting of a substantially circular body portion; a pair of extensions formed on and emanating from the body portion such that each extension of the pair of extensions are disposed mutually opposite each other on the body portion and are colinear; and means for fastening each extension of the pair of extensions around the wrist watch.

When the watch guard is designed in accordance with the present invention, the wrist watch crystal, the wrist watch is general, and the wrist watch band, are protected from breakage.

In accordance with another feature of the present invention, the fastening means include a hook and loop fastener, sold under the tradename of VELCROR disposed, respectively, on each extension of the pair of extensions.

Another feature of the present invention is that the fastening means include a two part snap fastener disposed, respectively, on each extension of the pair of extensions.

Another feature of the present invention is that the central portion covering the watch face may contain an openable slit, for viewing the watch while the watch guard cover is on.

Yet another feature of the present invention is that the fastening means include a buckle fastener disposed, respectively, on each extension of the pair of extensions.

Still another feature of the present invention is that the substantially circular body portion and the pair of extensions are closed cell neoprene so that the closed cell neoprene circular body portion can stretch and fit over a variety of sized watch face.

Yet still another feature of the present invention is that the hook and loop fasteners provide for different sized wrists.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 2 is a perspective view of a person utilizing the preferred embodiment of the present invention;

FIG. 6 is a perspective view of the preferred embodiment of the present invention showing the loop and hook type fastener;

FIG. 7 is a perspective view of the first alternate embodiment of the present invention in the closed position showing a snap type fasteners; and FIG. 8 is a perspective view of the second alternate embodiment of the present invention in the closed position showing a buckle type fastener.

LIST OF REFERENCE NUMERALS UTILIZED IN THE DRAWING

Figure 1:
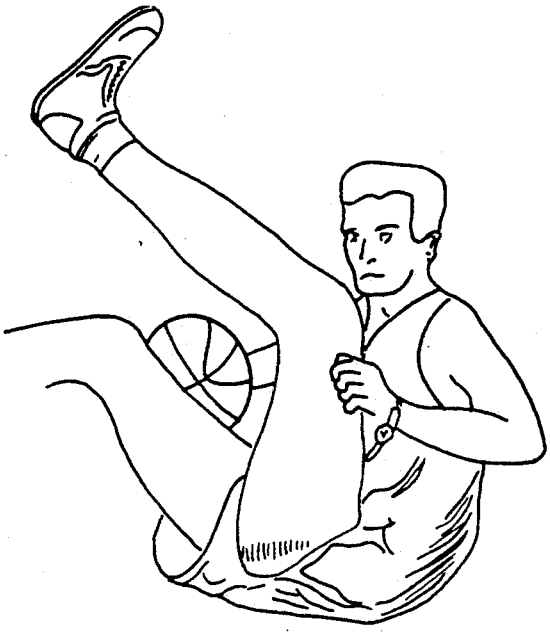
FIG. 1 is a perspective view of a person not utilizing the present invention.

10 - watch guard of the preferred embodiment of the present invention
12 - user
13 - watch
14 - crystal of the watch 13
16 - wide body central portion
18 - a longitudinal axis
20 - extension
22 - extension
24 - longitudinal axis of the extension 20
26 - longitudinal axis of the extension 22
**16*a*** - upper portion of central portion
**16*b*** - lower portion of central portion
**16*c* - rounded edge of upper portion 16*a* of central portion 16**
**16*d* - rounded edge of lower portion 16*b* of central portion 16**
28 - fasteners
30 - hooks
32 - loops
10'- first embodiment of the present invention
16'- wide body central portion
18'- longitudinal axis
20'- extension
22'- extension
24'- longitudinal axis of the extension 20'
26'- longitudinal axis of the extension 22'
28'- fastener
29'- male portion of the snap 32'
34 - slit of central body portion
**34*a*** - one end of slit
**34*b*** - other end of slit
31'- female portion of the snap 32'
32'- snap
10''- second embodiment of the present invention
16''- wide body central portion 16''
18''- longitudinal axis
20''- extension
22''- extension
24''- longitudinal axis of the extension 20''
26''- longitudinal axis of the extension 22''
28''- fasteners
29''- buckle
33''- strap

DETAILED DESCRIPTION OF THE PREFERRED EMBODIMENT

Referring now to FIG. 2, the watch guard of the present invention is shown generally at 10 worn by a user 12, to protect the watch 13, especially the crystal 14.

Figure 3:
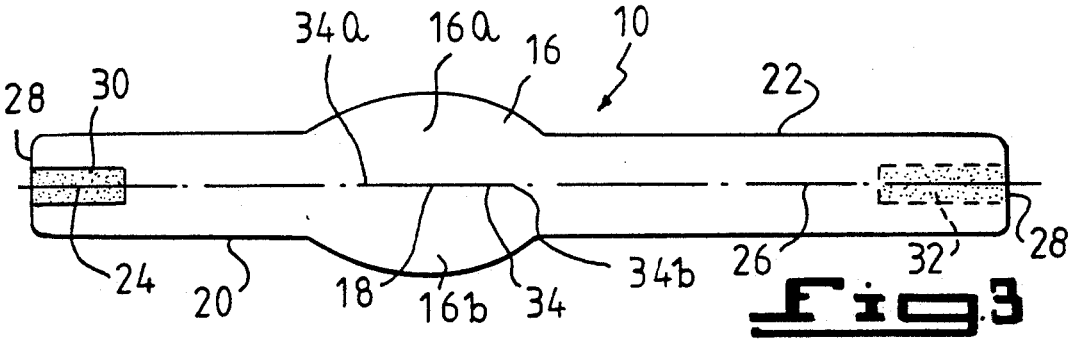
FIG. 3 is a perspective view of the present invention in an open position showing a loop and hook type fastener.

As shown in FIGS. 3 and 6, the watch guard of the preferred embodiment of the present invention is shown at 10. The watch guard of the preferred embodiment of the present invention 10 consists of a wide body central portion 16, a longitudinal axis 18, and a pair of extensions 20,22 also having a longitudinal axis 24 and 26, respectively.

Additionally each of the extensions 20 and 22 include fasteners 28 which in the preferred embodiment are hooks 30 and loops 32.

Figure 4:
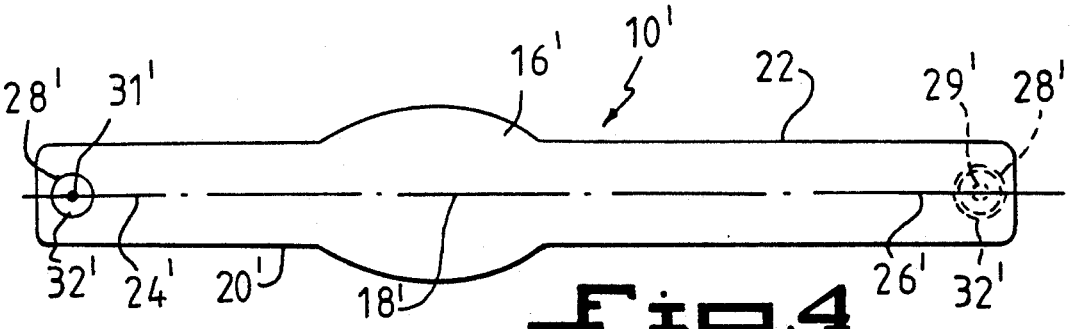
FIG. 4 is a perspective view of a first alternate embodiment of the present invention in the open position showing a snap type fastener.

As shown in FIGS. 4 and 7, the watch guard of a first alternate embodiment of the present invention shown at 10' and consists of a wide body central portion 16', a longitudinal axis 18' and a pair of extensions 20',22' also having a longitudinal axis 24' and 26', respectively.

Additionally, each of the extensions 20' and 22' include fasteners 28' which in the first alternate embodiment consists of a male portion 29' and a female portion 31' of a snap 32'.

Figure 5:
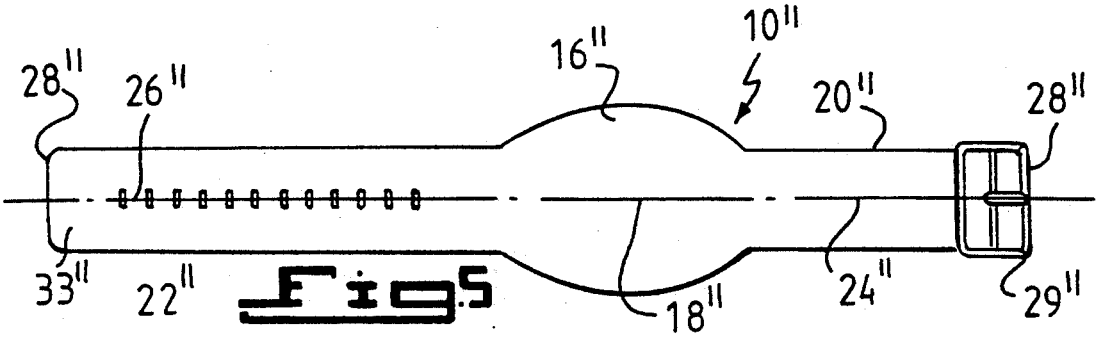
FIG. 5 is a perspective view of a second alternate embodiment of the present invention in the open position showing a buckle type fastener.

As shown in FIGS. 5 and 8, the watch guard of the second alternate embodiment of the present invention is 10''. The watch guard of the second embodiment of the present invention 10'' consists of a wide body central portion 16'', a longitudinal axis 18'', and a pair of extensions 20'' and 22'' also having a longitudinal axis 24'' and 26'', respectively.

The longitudinal axis 18'', the longitudinal axis 24'', and the longitudinal axis 25'' are all colinear.

Additionally each of the extensions 20'' and 22'' include fasteners 28'' which in the second alternate embodiment consists of a buckle 29'' and strap 33'', respectively.

Figure 9:
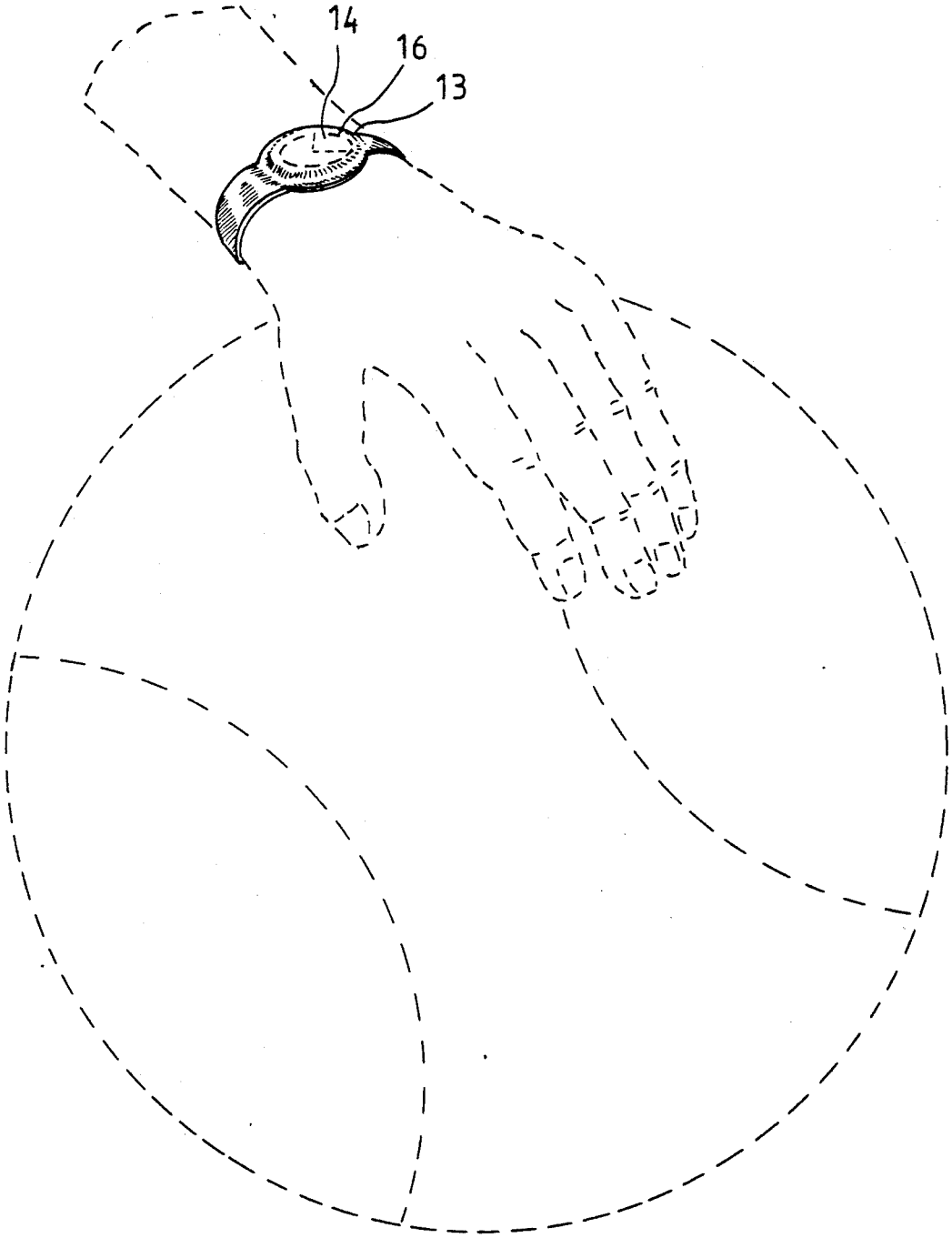
FIG. 9 is a perspective view of the preferred embodiment of the present invention shown in place over a typical watch face.

As shown in FIG. 9, central portion 16 conforms to the curved surfaces of watch 13 and crystal 14 by being bendable in a three dimensional spatial relationship against the curved, irregular surfaces of watch 13 and crystal 14. In order to fully protect the watch 13 and crystal 14, the central portion 16 forms a tight fit, but is removably adjacent to said watch 13 and crystal 14. The central portion 16 acts as a sealing means. While it is substantially planar in its unflexed state, the circular portion 16 is capable of conforming to the curved, irregular surfaces of the watch 13 and crystal 14, as shown in FIG. 9, and is bendable in a three dimensional spatial relationship against the curved, irregular surfaces of said watch 13 and crystal 14. The central portion 16, which acts as a sealing means, is substantially flat in its unflexed state. The bottom edge of the circular portion 16 is bendable in a three dimensional spatial relationship, against the curved, irregular surface of the watch crystal and completely covers the watch 13 and crystal 14 forming a seal capable of overlapping any spatial gaps between the skin of the wearer and the watch 13 itself. The outer bottom surface of the circular portion 16 is compressed downward against the skin of the wearer of the watch 13 to form a tight seal against environmental hazards and contaminants. Removably adjacent to the face of the crystal 14 and the watch 13, as well as the surface of the skin of the wearer, the central portion 16 has an upper exterior flexible portion 16*a* and a lower flexible exterior portion 16*b*, each flexible portion having outer edges 16*c* and 16*d* respectively, either of which said flexible portions 16*a* or 16*b* can be lifted up in order to view the time on the watch face in use.

In a preferred embodiment as shown in FIG. 3, in order to permit the wearer to conveniently and quickly view the watch 13 while the watch guard 10 is worn, there is alternatively provided within central body portion 16 a slit 34 extending along a portion of longitudinal axis 18 of watch guard 10. Slit 34 separates and bisects wide body central portion 16 into the aforementioned two flexible exterior portions 16*a* and 16*b*, each flexible portion having respective rounded edges 16*c* and 16*d* respectively, said rounded edges 16*c* and 16*d* each extending in opposite directions perpendicular to the longitudinal axis 18 of said watch protector 10. Slit 34 has-corresponding end parts 34*a* and 34*b*, which limit the length of slit 34. When a wearer wishes to observe the watch 13, the wearer places one finger upon flexible portion 16*a* of central portion 16 and another finger, or thumb, upon flexible portion 16*b* of central portion 16 and applies manual force to dislodge said flexible portions apart from each other along a line formed by slit 34. By dislodging flexible portions 16*a* and 16*b* away from each other in a movement perpendicular to the longitudinal axis 18 of watch guard 10, the resilient materials of wide body central portions 16*a* and 16*b* are caused to separate openly, thereby revealing the visible portion of the face of watch 13.

It will be understood that each of the elements described above, or two or more together, may also find a useful application in other types of constructions differing from the type described above.

While the invention has been illustrated and described as embodied in a-watch guard device, it is not intended to be limited to-the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A universal wrist watch and watch band protector being one homogeneous piece, said protector being one homogeneous piece of material comprising:

a substantially circular flexibly resilient flat body central portion;

a pair of flexibly resilient separate flat extensions having a thickness equal to said thickness of said substantially circular flexibly resilient flat body central portion, said pair of extensions being formed on and emanating from said substantially circular flexibly resilient flat body central portion such that said pair of extensions dispose mutually opposite to each other on said substantially circular flexibly resilient flat body central portion, said extensions being collinear, said substantially circular flexibly resilient flat body central portion and said extensions being one piece of homogeneous closed cell flexibly resilient flat neoprene material such that said substantially circular flexibly resilient flat body central portion can stretch and fit over the top and all sides of a face of said watch, said extensions extending over the band of said wrist watch;

said extensions each having an end opposite to said substantially circular flexibly resilient flat body central portion;

means for fastening each said end of each said extension of said pair of extensions around the wrist watch so that the wrist watch face and the wrist watch band are protected from breakage and environmental contaminants;

said substantially circular flexibly resilient flat body central portion extending over a contour of said wrist watch and said watch face, said substantially circular flexibly resilient flat body central portion having a substantially circular shape arranged to be placed onto said wrist watch and watch face and having a bottom edge arranged to face toward said watch face;

sealing means being said substantially circular flexibly resilient flat body central portion, said substantially circular flexibly resilient flat body central portion being substantially planar in its unflexed state, and said substantially circular flexibly resilient flat body central portion being bendable in a three dimensional spatial relationship against the wrist watch and watch face;

said sealing means being further capable of overlapping spatial gaps between said watch and the skin of the wearer of said watch;

said sealing means being removably adjacent to said wrist watch and said watch face, and a slit extending axially within said substantially circular flexibly resilient flat body central portion "and in said collinear direction of said extensions", said slit closable in said substantially circular flexibly resilient flat body central portion, said slit having a pair of end parts limiting the length of said slit, said slit bisecting said substantially circular flexibly resilient flat body central portion into a first flexible portion and a second flexibly portion, said first and second flexible portions being removably adjacent to each other when said slit is in a closed position, said slit openable to an open position upon forcible separation of said first and second flexible portions form each other, and closable to a closed position upon release of said forcible separation of said first and second flexible portions.

* * * * *